US011306585B2

(12) United States Patent
Theunissen

(10) Patent No.: US 11,306,585 B2
(45) Date of Patent: Apr. 19, 2022

(54) SYSTEM AND METHOD FOR SPECIFYING AND CONTROLLING SUMP DEPTH

(71) Applicant: Joy Global Underground Mining LLC, Warrendale, PA (US)

(72) Inventor: Wilhelmus Henrickus Theunissen, Gauteng (ZA)

(73) Assignee: Joy Global Underground Mining Inc, Warrendale, PA (US)

( * ) Notice: Subject to any disclaimer, the term of this patent is extended or adjusted under 35 U.S.C. 154(b) by 0 days.

(21) Appl. No.: 16/782,276

(22) Filed: Feb. 5, 2020

(65) Prior Publication Data

US 2020/0248550 A1 Aug. 6, 2020

Related U.S. Application Data

(60) Provisional application No. 62/801,405, filed on Feb. 5, 2019.

(51) Int. Cl.
*E21C 35/24* (2006.01)
*E21C 27/24* (2006.01)

(52) U.S. Cl.
CPC ..... *E21C 35/24* (2013.01); *E21C 27/24* (2013.01)

(58) Field of Classification Search
CPC ..... E21C 35/24; G05B 2219/45004
See application file for complete search history.

(56) References Cited

U.S. PATENT DOCUMENTS

| | | | | |
|---|---|---|---|---|
| 2,030,535 | A | 2/1936 | Pratt | |
| 4,192,551 | A * | 3/1980 | Weimer | E21C 35/24 299/1.4 |
| 4,952,000 | A * | 8/1990 | Lipinski | E21C 35/24 299/1.1 |
| 6,666,521 | B1 | 12/2003 | Pease et al. | |
| 2015/0056583 | A1 | 2/2015 | Felege et al. | |
| 2015/0061351 | A1* | 3/2015 | Paterson | E21C 35/08 299/1.4 |
| 2016/0102551 | A1 | 4/2016 | Paterson | |

OTHER PUBLICATIONS

SAIMM Realising the Productivity Potential of Joy Continuous Miners in Underground South African Coal Mines Dean Hoare (Year: 2016).*
International Search Report and Written Opinion for Application No. PST/US2020/016762 dated Apr. 28, 2020 (13 pages).

* cited by examiner

*Primary Examiner* — Janine M Kreck
(74) *Attorney, Agent, or Firm* — Michael Best & Friedrich LLP

(57) ABSTRACT

An industrial machine comprising a chassis, a cutting head supported by the chassis, and a controller. In one embodiment, the controller, having an electronic processor and memory, is configured to receive an input via an operator, indicating at least one selected from a group consisting of a desired volume of a material to be mined and a desired weight of the material to be mined, determine a sump depth of the cutting head based on the input, and control the industrial machine based on the sump depth.

20 Claims, 4 Drawing Sheets

SYSTEM AND METHOD FOR SPECIFYING AND CONTROLLING SUMP DEPTH

RELATED APPLICATIONS

This application claims priority to U.S. Provisional Patent Application No. 62/801,405, filed Feb. 5, 2019, the disclosure of which is hereby incorporated by reference.

FIELD

Embodiments relate to industrial machines.

SUMMARY

Industrial machines, such as underground mining machines, may use a plurality of cutter bits attached to a rotating cutting head in order to mine (for example, cut) material. While mining, the mined material may be unloaded into a hauling vehicle (for example, a truck) to be removed from the mining area. Currently, the sump depth, or the distance by which the industrial machine mines into the material, is visually estimated or manually measured by an operator. It would be beneficial to automatically calculate the sump depth via an electronic controller by accounting for a desired volume and/or a desired weight of the material to be mined.

Thus, one embodiment provides an industrial machine including a chassis, a cutting head, and a controller. The cutting head is supported by the chassis. The controller, having an electronic processor and memory, is configured to receive an input, via an operator, indicating at least one selected from a group consisting of a desired volume of the material to be mined and a desired weight of the material to be mined, determine a sump depth of the cutting head based on the input, and control the industrial machine based on the sump depth. In some embodiments, a sump depth advance of the industrial machine is controlled via a sump frame and/or a traction device.

Another embodiment provides a method of determining a sump depth for an industrial machine. The method includes receiving an input via an operator, indicating at least one selected from a group consisting of a desired volume of a material to be mined and a desired weight of the material to be mined, determining a sump depth of the cutting head based on the input, and controlling the industrial machine based on the sump depth.

Other aspects of the application will become apparent by consideration of the detailed description and accompanying drawings.

DETAILED DESCRIPTION

Before any embodiments of the application are explained in detail, it is to be understood that the application is not limited in its application to the details of the configuration and arrangement of components set forth in the following description or illustrated in the accompanying drawings. The application is capable of other embodiments and of being practiced or of being carried out in various ways. Also, it is to be understood that the phraseology and terminology used herein are for the purpose of description and should not be regarded as limiting. The use of "including," "comprising," or "having" and variations thereof herein are meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings.

In addition, it should be understood that embodiments of the application may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the application may be implemented in software (e.g., stored on non-transitory computer-readable medium) executable by one or more processing units, such as a microprocessor and/or application specific integrated circuits ("ASICs"). As such, it should be noted that a plurality of hardware and software based devices, as well as a plurality of different structural components may be utilized to implement the application. For example, "servers" and "computing devices" described in the specification can include one or more processing units, one or more computer-readable medium modules, one or more input/output interfaces, and various connections (e.g., a system bus) connecting the components.

Figure 1:
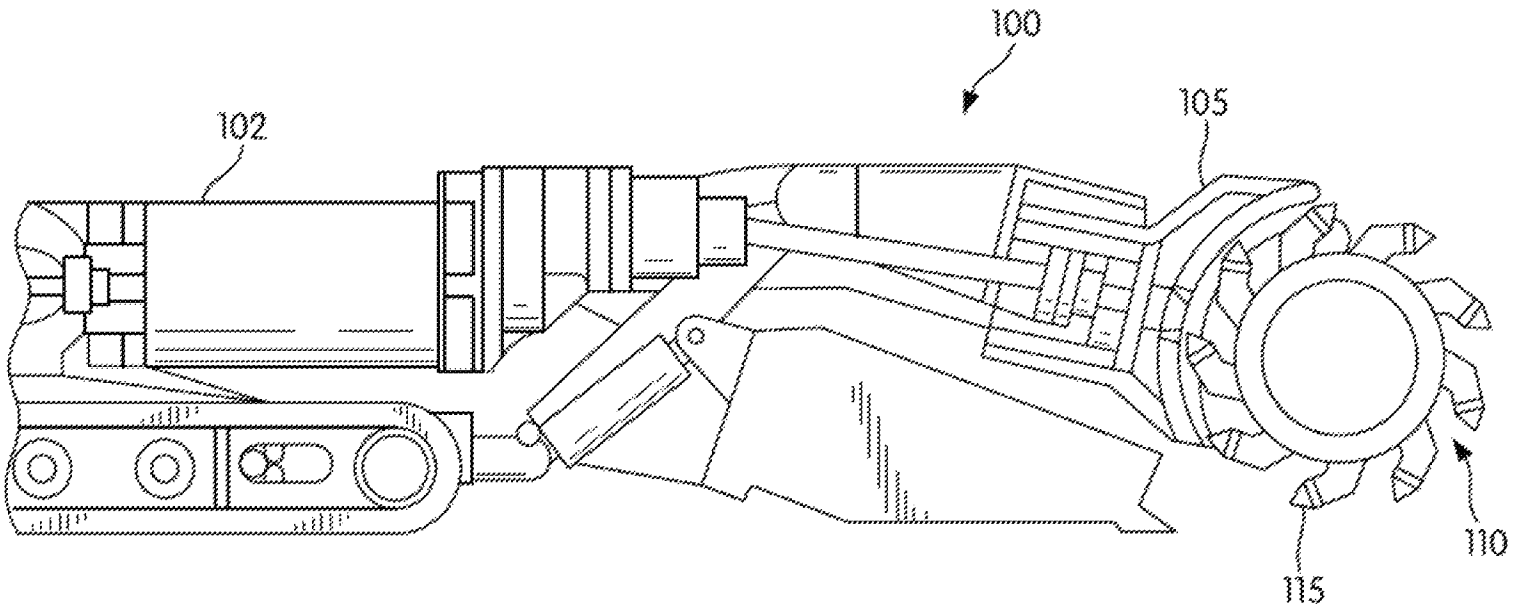
FIG. 1 illustrates a perspective view of an industrial machine according to some embodiments.

FIG. 1 illustrates an industrial machine 100, such as a mining machine, according to some embodiments. Although illustrated as a continuous miner, in other embodiments (not shown), the industrial machine 100 may be a long wall shearer, a rock crusher, or another type of mining machine. Additionally, embodiments are not limited to mining machines and may be used in conjunction with a variety of apparatuses having other types of cutting mechanisms such as oscillating discs or drill bits.

The industrial machine 100 includes a frame, or chassis, 102 supporting a cutting head 105, which includes a rotating drum 110 with one or more cutter bits 115 for cutting material (e.g., coal, salt, or another mined material) from a surface to be mined. In the illustrated embodiment, the cutting head 105 is raised and lowered via an actuator 230 (shown schematically in FIG. 2) and extend and retracted via a sump frame 233 (shown schematically in FIG. 2). In other embodiments, the cutting head 105 may be advanced forward, or retracted, via one or more traction devices 232 (shown schematically in FIG. 2) coupled to the chassis 102. In such an embodiment, the industrial machine 100 may be advanced forward and/or retracted via the traction devices 232. The one or more traction device 232 may include for example, tracks and/or wheels.

The cutting head 105 is rotationally driven via a gear box, or gear reducer, 240 (shown schematically in FIG. 2), which mechanically connects to the rotating drum 110. The cutter bits 115 may be replaceably coupled to the drum 110.

Figure 2:
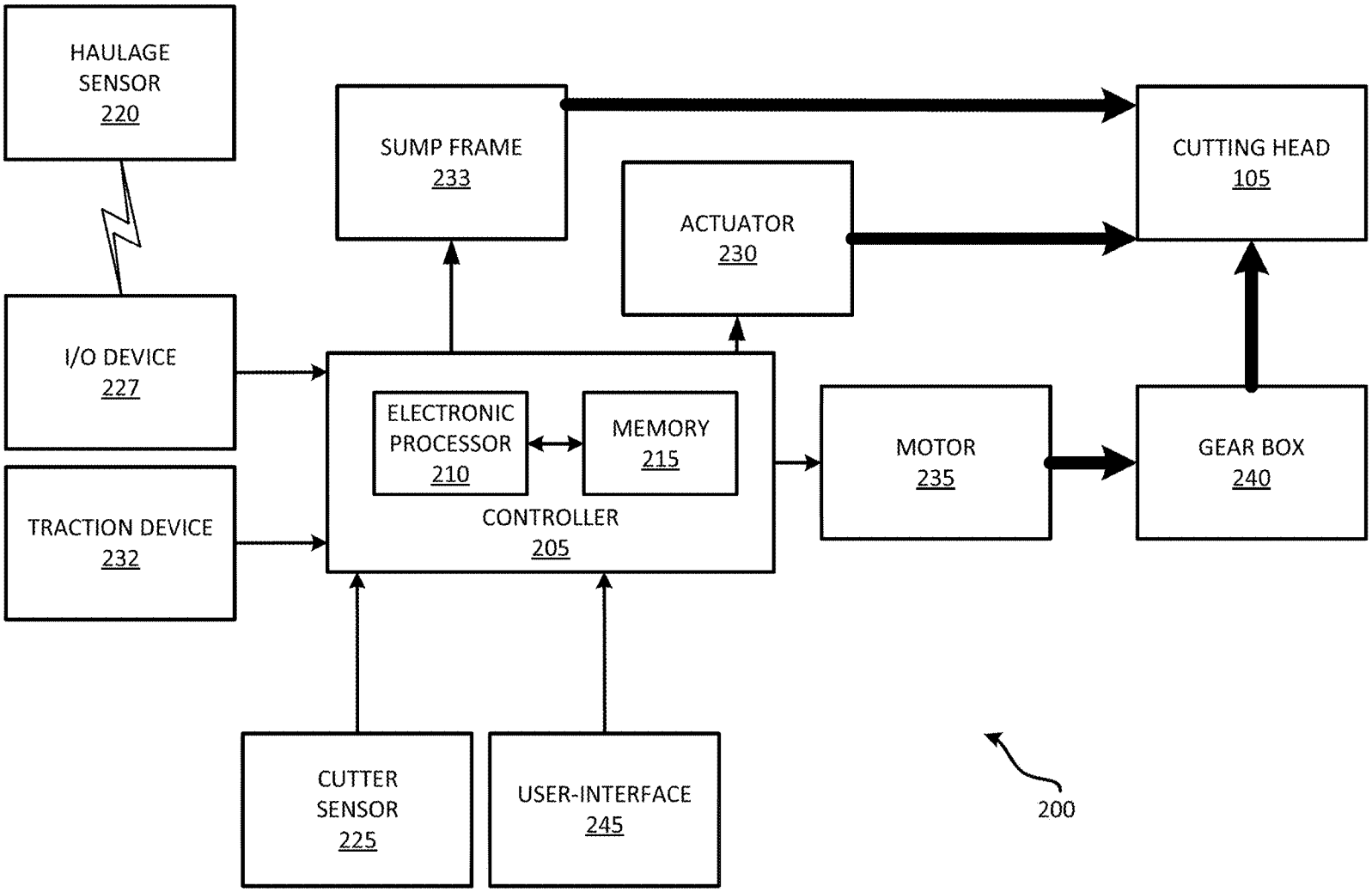
FIG. 2 illustrates a block diagram of the industrial machine controller according to some embodiments.

FIG. 2 illustrates a block diagram of a control system 200 of the industrial machine 100 according to some embodiments. The control system 200 includes, among other things, a controller 205 having combinations of hardware and software that are operable to, among other things, control the operation of the industrial machine 100 and operation of the control system 200. The controller 205 is electrically and/or communicatively connected to a variety of modules or components of the industrial machine 100, such as, but not limited to, cutter sensor 225, an I/O device 227, actuator 230, traction device 232, sump frame 233, and a motor 235. As illustrated, in some embodiments, the controller 205 is further communicatively connected to a haulage sensor 220 (for example, via I/O device 227227).

In some embodiments, the controller 205 includes a plurality of electrical and electronic components that provide power, operational control, and protection to the components and modules within the controller 205 and/or industrial machine 100. For example, the controller 205 includes, among other things, an electronic processor 210 (e.g., a microprocessor, a microcontroller, or another suitable programmable device) and a memory 215. The electronic processor 210 and the memory 215, as well as the various modules connected to the controller 205 are connected by one or more control and/or data buses. In some embodiments, the controller 205 is implemented partially or entirely on a semiconductor chip.

The memory 215 includes, for example, a program storage area and a data storage area. The program storage area and the data storage area can include combinations of different types of memory, such as read-only memory ("ROM"), random access memory ("RAM") (e.g., dynamic RAM ["DRAM"], synchronous DRAM ["SDRAM"], etc.), electrically erasable programmable read-only memory ("EEPROM"), flash memory, a hard disk, an SD card, or other suitable magnetic, optical, physical, or electronic memory devices. The electronic processor 210 is connected to the memory 215 and executes software instructions that are capable of being stored in a RAM of the memory 215 (e.g., during execution), a ROM of the memory 215 (e.g., on a generally permanent basis), or another non-transitory computer readable medium such as another memory or a disc. Software included in the implementation of the industrial machine 100 can be stored in the memory 215 of the controller 205. The software includes, for example, firmware, one or more applications, program data, filters, rules, one or more program modules, and other executable instructions. The controller 205 is configured to retrieve from memory 215 and execute, among other things, instructions related to the control processes and methods described herein. In other constructions, the controller 205 includes additional, fewer, or different components.

In some embodiments, the control system 200 may further include a user-interface 245 and/or an input/output (I/O) device 227. The user-interface 245 may be used to control or monitor the industrial machine 100 and includes a combination of digital and analog input or output devices used to achieve a desired level of control and/or monitoring of the industrial machine 100. The I/O device 227 may be configured to input and output data from the control system 200 to outside device(s), for example, through a network. The network may be, for example, a wide area network ("WAN") (e.g., a TCP/IP based network, a cellular network, such as, for example, a Global System for Mobile Communications ["GSM"] network, a General Packet Radio Service ["GPRS"] network, a Code Division Multiple Access ["CDMA"] network, an Evolution-Data Optimized ["EV-DO"] network, an Enhanced Data Rates for GSM Evolution ["EDGE"] network, a 3GSM network, a 4GSM network, a Digital Enhanced Cordless Telecommunications ["DECT"] network, a Digital AMPS ["IS-136/TDMA"] network, or an Integrated Digital Enhanced Network ["iDEN"] network, etc.). In other embodiments, the network is, for example, a local area network ("LAN"), a neighborhood area network ("NAN"), a home area network ("HAN"), or personal area network ("PAN") employing any of a variety of communications protocols, such as Wi-Fi, Bluetooth, ZigBee, etc. In some embodiments, the I/O device 227 may be configured to communicate with an external device via radio-frequency identification (RFID).

As discussed above, the industrial machine 100 may further include a gear box 240. The gear box 240 is driven by the motor 235. The motor 235 may be any motor such as, but not limited to, an alternating-current (AC) motor (e.g., a synchronous motor, an AC induction motor, etc.), a direct-current motor (e.g., a commutator direct-current motor, a permanent-magnet direct-current motor, a wound field direct-current motor, etc.), and a switched reluctance motor or other type of reluctance motor. In another embodiment, the motor 235 is a hydraulic motor, such as but not limited to, a linear hydraulic motor (i.e., hydraulic cylinders) or a radial piston hydraulic motor. In some embodiments, the mining machine 100 includes a plurality of motors 235 for operating various aspects of the mining machine 100. In such an embodiment, the motors 235 may be a combination of AC motors, DC motors, and hydraulic motors.

Controller 205 may further be communicatively and/or electrically connected to one or more of the haulage sensor 220 and/or cutter sensor 225, hence called the one or more sensors. The one or more sensors may be configured to sense one or more characteristics of one or more components (for example, but not limited to, the cutting head 105) of the mining machine 100 and/or a hauling vehicle 420 (illustrated in FIG. 4). For example, in some embodiments, the one or more sensors may be configured to sense the amount of material stored in the hauling vehicle 420 (for example, a weight of the material). In another embodiment, the sensors are configured to determine the density of the material to be mined.

The haulage sensor 220 may be configured to sense and/or determine a weight of mined material. In some embodiments, the haulage sensor is located on a haulage vehicle 420 (shown schematically in FIG. 4) and is configured to sense a weight of mined material held, or contained, by the haulage vehicle 420. In such an embodiment, the sensed weight is communicated to controller 205 via the I/O device 227. In other embodiments, the haulage sensor 220 is located on the industrial machine 100 and is configured to sense a weight of mine material. In such an embodiment, the industrial machine 100 (for example, via the I/O device 227) communicates the sensed weight to the haulage vehicle 420.

In some embodiments, the haulage vehicle 420 may be configured to carry a predetermined capacity of mined material. In such an embodiment, the haulage vehicle 420 is configured to communicate (for example, via the I/O device 227) the predetermined capacity to the industrial machine 100. The industrial machine 100 may then sense, via an on-board haulage sensor 220, the weight of material being mined, and deposit mined material to the haulage vehicle 420 corresponding to the predetermined capacity. In some embodiments, the industrial machine 100 may determine the amount of mined material using methods other than haulage sensor 220. In such an embodiment, the industrial machine may deposit the mined material to the haulage vehicle 420 corresponding to the predetermined capacity.

In some embodiments, the industrial machine 100 is set to mine a predetermined weight of material. The industrial machine 100 may then deposit the mined material approximately equal to the predetermined weight to one or more haulage vehicles 420.

Figure 3:
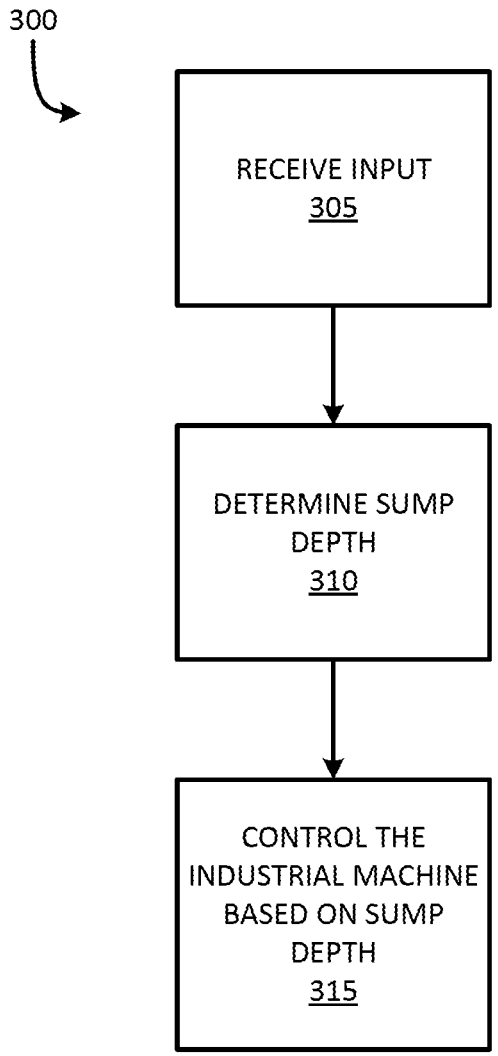
FIG. 3 is a flow chart illustrating a process of the industrial machine of FIG. 1 according to some embodiments.

The controller 205 may also further be communicatively and/or electrically connected to the actuator 230. In some embodiments, the actuator 230 controls the cutting head 105 in a vertical direction (for example, raising and lowering the cutting head 105). In one embodiment, the controller 205 uses received operator inputs to control the actuator 230, and therefore cutting head 105, as shown in FIG. 3. In another embodiment, the controller 205 uses signals received by the one or more sensors to control the actuator 230, and therefore cutting head 105. In yet another embodiment, the controller 205 uses received operator inputs to control the motor 235 to spin the gear box 240, therefore controlling the cutting head 1015. For example, the one or more sensors may indicate that a material is dense (for example, above a density threshold) and send a signal to the controller 205 indicating a change in cutting speed.

The controller 205 may also be communicatively and/or electrically connected to the sump frame 233 and/or traction device 232. In some embodiments, the sump frame 233 is an actuator (for example, but not limited to, a hydraulic actuator) configured to control the cutting head 105 in a horizontal direction (for example, in a forward and reverse direction).

In general operation, the industrial machine 100 mines material according to a sump depth. The sump depth advance of the industrial machine 100 may be varied based on the sump frame 233 and/or traction device 232 of the industrial machine 100.

In one embodiment of operation, the controller 205 receives an input (for example, a desired mined material weight and/or a desired mined material volume). The controller 205 determines a sump depth of the cutting head 105 based on the input, and controls the cutting head 105 according to the determined sump depth. In some embodiments the controller 205 determines the sump depth based on cutting height, a cutting width, a density of the material being cut, a cutting profile of the machine, and/or a face profile (for example, a flat face and/or a curved face) of the surface to be mined. For example, the controller 205 may determine the sump depth using Equations 1 through 3 below, wherein V=volume, ρ=density, and m=mass.

$$V = CuttingHeight \times CuttingWidth \times SumpDepth \quad \text{[Equation 1]}$$

$$\rho = \frac{m}{V} \quad \text{[Equation 2]}$$

Solving for SumpDepth is performed by Equation 3 and solving for a $SumpDepth_{adj}$ is performed by 4 below.

$$SumpDepth = \frac{V}{H \times W} = \frac{m}{\rho} \times \frac{1}{H \times W} = \frac{m}{\rho \times H \times W} \quad \text{[Equation 3]}$$

$$SumpDepth_{adj} = AdjustmentFactor \times \frac{m}{\rho \times H \times W}$$

Where H=cutting height, W=cutting width, and AdjustmentFactor is a factor that may be used in adjusting the calculation of SumpDepth to cater for losses during operation of the industrial machine, measurement accuracy, etc. The AdjustmentFactor may be at least partially based on feedback information from a haulage sensor 220.

Additionally, in some embodiments, the controller 205 may continuously and/or automatically determine a sump depth during operation of the machine 100 based on feedback from the one or more sensors. For example, the controller 205 may continuously receive sensed information concerning the cutting height, cutting width, density of the material being cut, cutting profile of the machine, and/or face profile, update the sump depth accordingly, and control the cutting head 105 according to the updated sump depth.

FIG. 3 is a flow chart illustrating a process 300 of the industrial machine 100 of FIG. 1 according to some embodiments. It should be understood that the order of the steps disclosed in process 300 could vary. Furthermore, additional steps may be added to the sequence and not all of the steps may be required.

At block 305, the controller 205 receives an input. The input may indicate at least one selected from a group consisting of a desired volume of a material to be mined and a desired weight of the material to be mined. In one embodiment, the input is received based on an input by an operator of the industrial machine 100 (for example, via user-interface 245). In another embodiment, the input may be stored in the memory 215. In yet another embodiment, the input may be received from the one or more sensors. In such an embodiment, the one or more sensors may sense characteristics of one or more components (for example, the cutting head 105, the hauling vehicle 420 (FIG. 4), etc.).

In some embodiments, a second input may be received. The second input may indicate, for example, at least one selected from a group consisting of a cutting height, a cutting width, a density of the material being cut, and/or a cutting profile of the machine. The second input may be determined based on settings stored in the memory 215. Alternatively, the second input may be based on a user input.

At block 310, the controller 205 determines a sump depth (for example, using Equation 3 above). In one embodiment, the sump depth is determined based on the input received in block 305. In another embodiment, the sump depth is determined based on both the input received in block 305 and the second input.

At block 315, the controller 205 controls the industrial machine 100 (for example, controls a sump depth advance of the industrial machine 100) according to the determined sump depth. In some embodiments, the industrial machine 100 is controlled via the sump frame 233 and/or the traction device 232. For example, the controller 205 may signal to the sump frame 233 and/or the traction device 232 to extend the cutting head 105 further in order to cut more material.

In some embodiments, a tool 103 on or for use with the industrial machine 100 allows an operator of the machine to adjust the sump depth manually. In such an embodiment, the operator receives feedback corresponding to the manual adjustment (for example, feedback via user-interface 245 and/or a separate display). The feedback may be based on similar sump depth calculations discussed above. In some embodiments, the feedback provides information (for example, instructions) to the operator to manually adjust the sump depth to an optimal value. The tool 103 may be, for example, a level, a wrench, or a stick shift. In some embodiments, the tool 103 may be used in addition to or in place of step 315.

Figure 4:
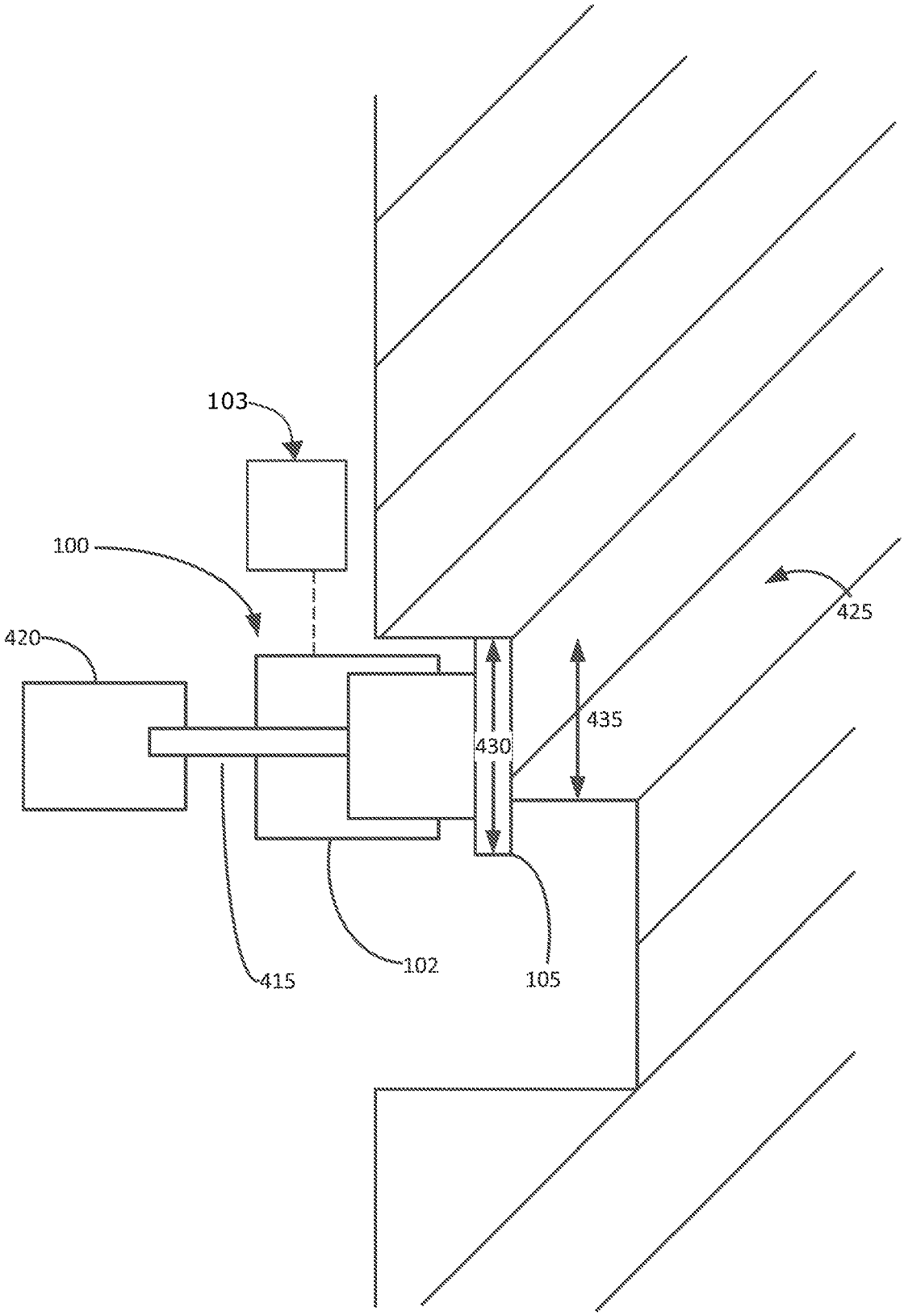
FIG. 4 is a top view of the industrial machine of FIG. 1 and a hauling vehicle according to some embodiments.

FIG. 4 is a top view of a mining machine and hauling truck according to some embodiments. As stated above, industrial machine 100 (for example, a continuous miner) may deposit material to hauling vehicle 420 via a conveyer 415. Conveyer 415 may be any device that allows for material to be transferred between the industrial machine 100 and hauling vehicle 420, such as a slide, a chute, or a belt.

In some embodiments, the controller 205 is further configured to adjust the calculated sump depth due to differences in mined material between a first cutting operation and a second cutting operation. During mining operation, multiple cutting operations may occur. Each cutting operation may cut varying amounts of material and use varying amounts of the cutting head 105, ranging from little use (approximately 1% or less) to full use (approximately 100%). For example, in a first cutting operation, material is cut using the entire width of cutting head 105, illustrated by line 430. During a second cutting operation, material may be cut using the width of cutting head 105 illustrated by line 435. Line 435 may be, for example, approximately 75% of the width of line 430. Since line 435 is shorter, cutting head 105 cuts less of the mined material during the second cutting operation. When calculating the sump depth, the controller 205 may adjusts calculations based on the differences between cutting operations (for example, a difference between a first width of material mined during a first cutting operation and a second width of material mined during a second cutting operation.

Thus, the application provides, among other things, an industrial machine and method for determining a sump depth of a mining machine based on at least one selected from a group consisting of a desired volume of a material to be mined and a desired weight of the material to be mined. Various features and advantages of the application are set forth in the following claims.

What is claim is:

1. An industrial machine comprising:

a chassis;

a cutting head supported by the chassis; and a controller, having an electronic processor and a memory, the controller configured to receive, via a user interface of the industrial machine, a user input indicating at least one selected from a group consisting of a desired volume of a material to be mined and a desired weight of the material to be mined, determine a sump depth of the cutting head based on the user input, and control the industrial machine based on the sump depth.

2. The industrial machine of claim 1, wherein the controller is further configured to receive a second input, the second input indicating at least one selected from a group consisting of a cutting height, a cutting width, a density of the material being cut, and a cutting profile of the machine, wherein the sump depth is further based on the input and the second input.

3. The industrial machine of claim 1, wherein the controller is further configured to adjust for differences in sump depth between a first cutting operation and a second cutting operation.

4. The industrial machine of claim 1, wherein the controller is further configured to automatically adjust the sump depth based on feedback from a sensor.

5. The industrial machine of claim 1, wherein a tool of the industrial machine allows an operator of the machine to manually adjust the sump depth.

6. The industrial machine of claim 1, wherein the controller is further configured to provide, via the user interface, feedback on a calculation of one or more of a volume or one or more of a weight to the operator.

7. The industrial machine of claim 5, wherein the tool is at least one selected from a group consisting of a wrench and a stick shift.

8. The industrial machine of claim 1, wherein the industrial machine is controlled via at least one selected from a group consisting of a sump frame and a traction device.

9. A method of controlling an industrial machine, the method comprising:

receiving, via a user interface of the industrial machine, a user input indicating at least one selected from a group consisting of a desired volume of a material to be mined and a desired weight of the material to be mined, determining, using a controller of the industrial machine, a sump depth of the cutting head based on the user input, and controlling, using the controller, the industrial machine based on the sump depth.

10. The method of claim 9, wherein the method further includes:

receiving a second input, the second input indicating at least one selected from a group consisting of a cutting height, a cutting width, a density of the material being cut, and a cutting profile of the machine, wherein the sump depth is further determined on the input and the second input.

11. The method of claim 9, further comprising adjusting for differences in sump depth between a first cutting operation and a second cutting operation.

12. The method of claim 9, further comprising automatically adjusting the sump depth based on feedback from a sensor.

13. The method of claim 9, wherein a tool on or for of the industrial machine allows an operator of the machine to manually adjust the sump depth.

14. The method of claim 10, further comprising providing, via the user interface, feedback on a calculation of one or more of a volume or one or more of a weight.

15. The method of claim 13, wherein the tool is at least one selected from a group consisting of a wrench and a stick shift.

16. The method of claim 9, wherein the industrial machine is controlled via at least one selected from a group consisting of a sump frame and a traction device.

17. The industrial machine of claim 1, wherein the controller is further configured to receive a second input, the second input indicating a cutting profile of the industrial machine, wherein the sump depth is further based on the input and the second input.

18. The industrial machine of claim 17, wherein the cutting profile of the material being cut is stored within the memory.

19. The method of claim 9, wherein the method further includes:

receiving a second input, the second input indicating a cutting profile of the industrial machine, wherein the sump depth is further determined on the input and the second input.

20. The method of claim 19, further comprising storing, within a memory, the cutting profile of the material being cut.

* * * * *